US011248336B2

(12) United States Patent
Couet et al.

(10) Patent No.: US 11,248,336 B2
(45) Date of Patent: Feb. 15, 2022

(54) IRON WITH A FILL OPENING FITTED WITH A SEAL

(71) Applicant: SEB S.A., Ecully (FR)

(72) Inventors: Bertrand Couet, Loire-sur-Rhone (FR); Laurent D'Oliviera Dias, Saint-Chamond (FR)

(73) Assignee: SEB S.A.

( * ) Notice: Subject to any disclaimer, the term of this patent is extended or adjusted under 35 U.S.C. 154(b) by 72 days.

(21) Appl. No.: 16/801,615

(22) Filed: Feb. 26, 2020

(65) Prior Publication Data

US 2020/0283947 A1 Sep. 10, 2020

(30) Foreign Application Priority Data

Mar. 6, 2019 (FR) ..... 1902293

(51) Int. Cl.
*D06F 75/14* (2006.01)
*D06F 75/36* (2006.01)
*D06F 75/38* (2006.01)

(52) U.S. Cl.
CPC ..... *D06F 75/14* (2013.01); *D06F 75/36* (2013.01); *D06F 75/38* (2013.01)

(58) Field of Classification Search
CPC ..... D06F 75/00–38
See application file for complete search history.

(56) References Cited

U.S. PATENT DOCUMENTS 2,663,100 A * 12/1953 Bricker ..... D06F 75/14 38/77.81
2,880,530 A * 4/1959 Schwaneke ..... D06F 75/24 38/77.7
2,892,272 A * 6/1959 Finlayson ..... D06F 75/18 38/77.81
3,002,302 A * 10/1961 Flowers ..... D06F 75/18 38/77.5

(Continued)

FOREIGN PATENT DOCUMENTS

CN 104562614 A 4/2015
ES 2529598 A1 2/2015

OTHER PUBLICATIONS

French Search Report for French Application 1902293 dated Oct. 22, 2019.

*Primary Examiner* — Ismael Izaguirre
(74) *Attorney, Agent, or Firm* — Lerner, David, Littenberg, Krumholz & Mentlik, LLP

(57) ABSTRACT

An iron has a heel on which the iron can rest during inactive ironing phases, an internal reservoir, a fill opening fluidly connected to the internal reservoir, a fill opening cover movable between a closed position and an open position, a seal configured to seal the fill opening when the fill opening cover is in the closed position, and a vent which is fluidly connected to the internal reservoir when the fill opening cover is in the closed position. The seal includes a barrier part extending into the internal reservoir, and a ventilation orifice which is fluidly connected to the vent, and which opens into the internal reservoir, the barrier part and the (Continued)

ventilation orifice being configured so as to prevent liquid from flowing from the internal reservoir and through the vent when the fill opening cover is in the closed position and the iron rests on the heel.

17 Claims, 6 Drawing Sheets

(56) References Cited

U.S. PATENT DOCUMENTS

| | | | | | |
|---|---|---|---|---|---|
| 3,418,736 | A * | 12/1968 | Kueser | D06F 75/14 | 38/77.81 |
| 4,578,884 | A * | 4/1986 | Nakao | D06F 75/14 | 38/77.3 |
| 4,748,755 | A * | 6/1988 | Bain, Jr | D06F 75/14 | 219/245 |
| 6,243,976 | B1 * | 6/2001 | Beverly | D06F 75/14 | 220/213 |
| 9,334,604 | B1 * | 5/2016 | Li | D06F 75/10 | |

* cited by examiner

[Fig 1]
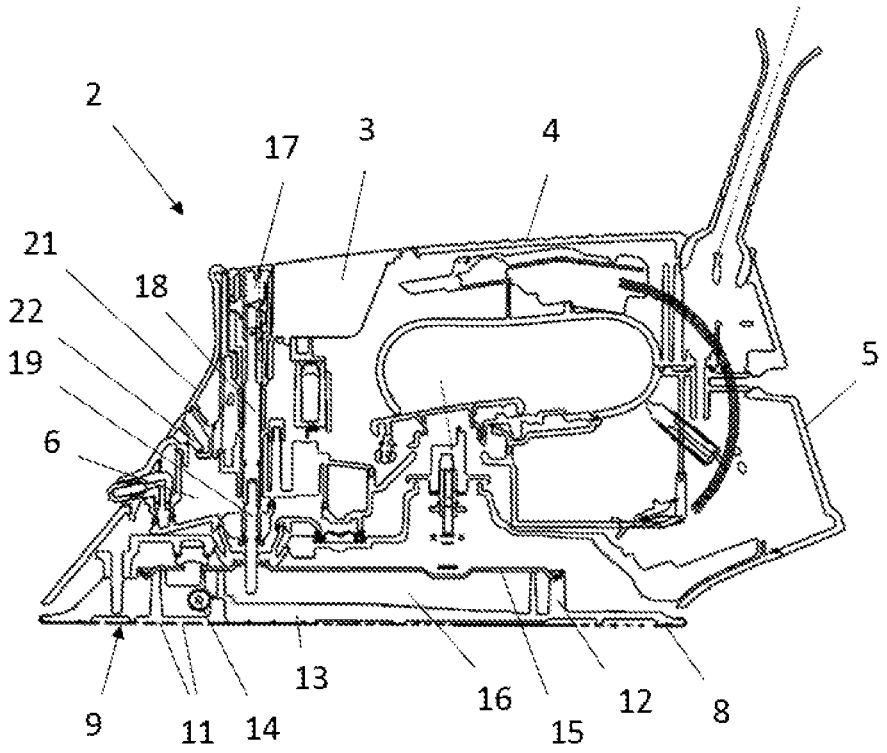

[Fig 2]
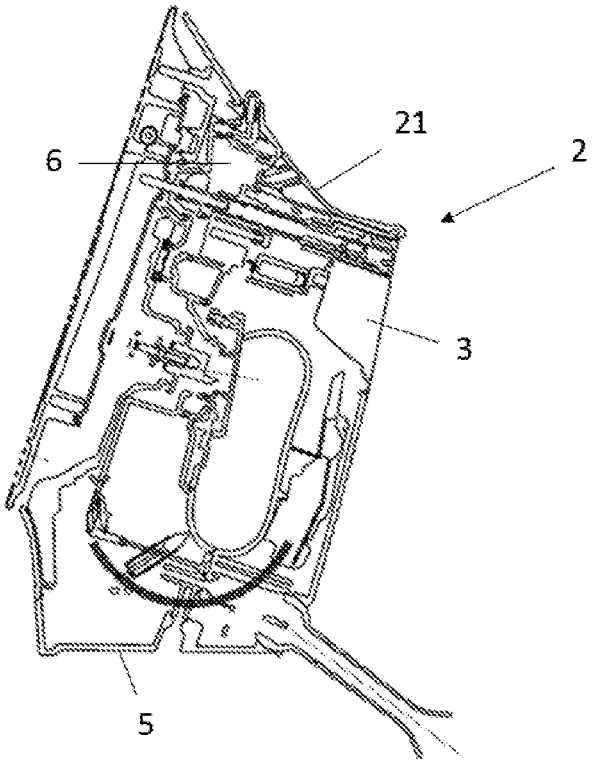

[Fig 3]
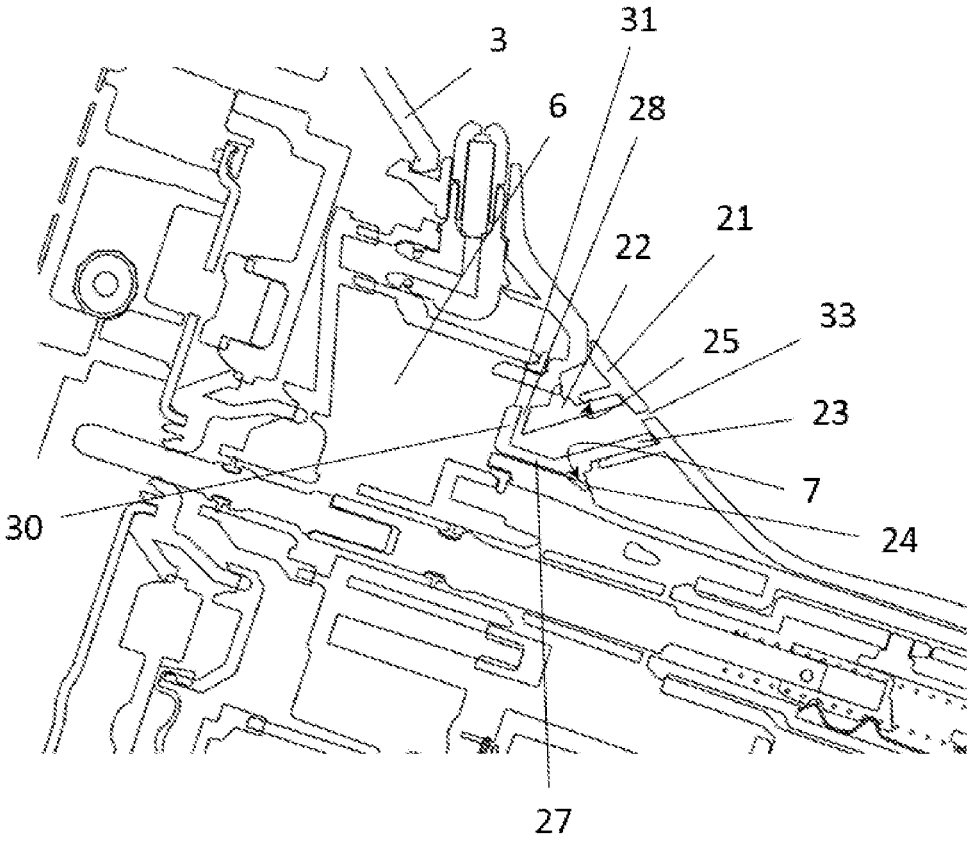

[Fig 4]
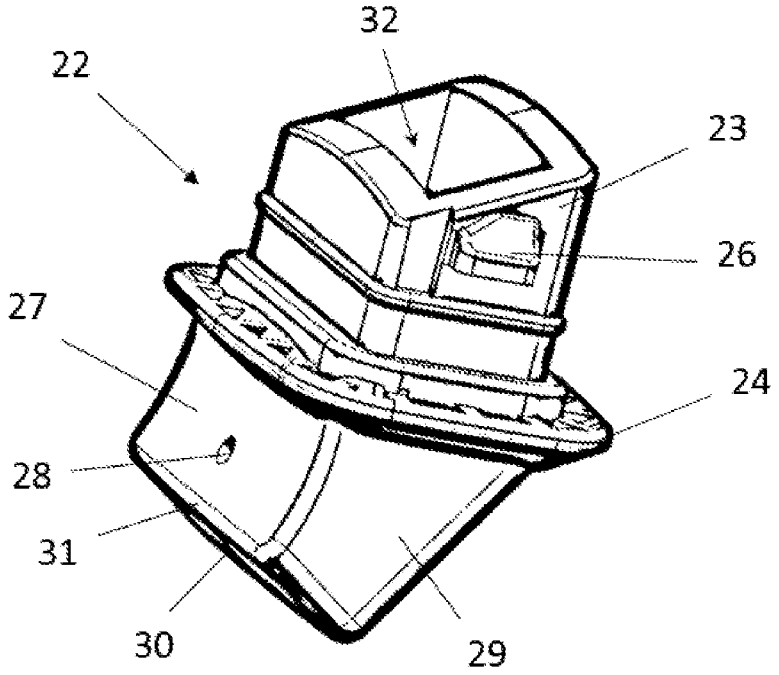

[Fig 5]
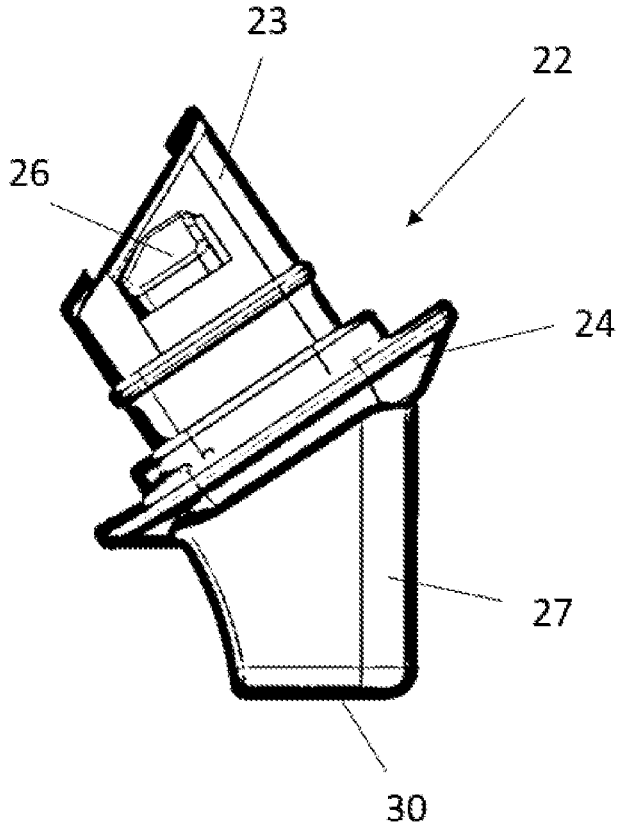

[Fig 6]
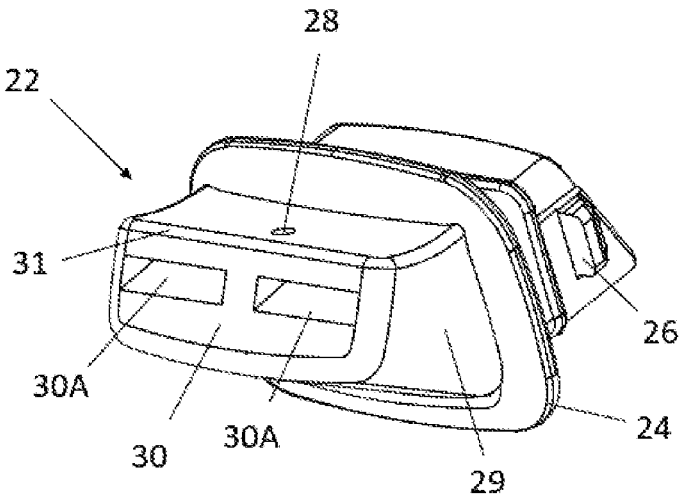

IRON WITH A FILL OPENING FITTED WITH A SEAL

CROSS-REFERENCE TO RELATED APPLICATIONS

This application claims priority from French application number 1902293, filed Mar. 6, 2019, the disclosure of which is hereby incorporated herein by reference.

FIELD OF THE INVENTION

The present invention relates to the field of irons.

BACKGROUND OF THE INVENTION

An iron has, in a known manner, a case equipped with a heel located in a rear part of the case and on which the iron can rest during the inactive ironing phases, an internal reservoir, a fill opening fluidly connected to the internal reservoir and opening into a front surface of the iron case, a movable fill opening between a closed position in which the fill opening covers the fill opening and prevents filling of the internal reservoir, and an open position in which the fill opening at least partially opens the fill opening and allows filling the internal reservoir, a seal comprising a mounting part fixed to the fill opening and a sealing part, which is configured to seal the fill opening when the fill opening is in the closed position, and a vent that is provided on the fill opening, the vent opening to the outside of the iron and being configured to be fluidly connected to the internal reservoir when the fill opening is in the closed position so as to allow air to enter the internal reservoir as and when the liquid contained in the internal reservoir is used, for example, in order to supply an iron vaporization chamber and/or a liquid spraying member provided in the case of the iron.

The seal more particularly comprises an internal cavity comprising a first open end into which the vent opens, and a second open end opening into the internal reservoir.

However, this configuration of the seal induces a spray of water and an accumulation of water on the internal surface of the internal cavity when the iron is moved from a position of use in which the iron is substantially horizontal to a rest position in which the iron rests on its heel, due to the movement of liquid generated in the internal reservoir by the movement of the iron. However, such an accumulation of water in the internal cavity of the seal causes liquid to flow through the vent and along the external surfaces of the fill opening and of the case, which are sources of dirt and discomfort for the user.

BRIEF SUMMARY OF THE INVENTION

Aspects of the present invention may remedy all or part of these drawbacks.

A technical problem underlying the invention consists in particular of providing an iron which has a simple and economical structure, while preventing any risk of water flowing through the vent during normal use of the latter, and in particular when the iron is moved from a position of use to a position of rest in which the iron rests on its heel.

To this end, the present invention relates to an iron comprising a case fitted with a heel located in a rear part of the case, on which the iron can rest during the inactive ironing phases, an internal reservoir, an fill opening fluidly connected to the internal reservoir and opening into a front surface of the iron case, a movable fill opening between a closed position in which the fill opening covers the fill opening and prevents filling the internal reservoir, and an open position in which the fill opening at least partially releases the fill opening and allows the filling of the internal reservoir, a seal comprising a mounting part fixed to the fill opening and a sealing part which is configured to seal the fill opening when the fill opening is in the closed position, and a vent provided on the fill opening, the vent opening to the outside of the iron and being fluidly connected to the internal reservoir when the fill opening is in the closed position, characterized in that the seal includes a barrier, part which extends into the internal reservoir when the fill opening is in the closed position, and a ventilation orifice, which is fluidly connected to the vent and which opens into the internal reservoir when the fill opening is in the closed position, the barrier part and the ventilation orifice being configured so as to prevent liquid from flowing from the internal reservoir and through the vent when the fill opening is in the closed position and the iron rests on the heel.

Such a configuration of the iron, and in particular of the barrier part and the ventilation orifice, avoids an accumulation of water droplets near the fill opening and considerably reduces, and even eliminates, the risk of water flowing through the ventilation orifice when the iron is moved from a position of use to a position in which the latter rests on its heel. Consequently, the seal, according to this invention, prevents the flow of water droplets through the vent and along the exterior surface of the fill opening and the exterior surface of the case.

The iron can also have one or more of the following characteristics, taken alone or in combination.

According to one embodiment of the invention, the barrier part and the ventilation orifice are configured so as to prevent liquid from flowing from the internal reservoir and through the ventilation orifice when the fill opening is in the closed position and the iron rests on the heel.

According to one embodiment of the invention, when the fill opening is in the closed position, the ventilation orifice is oriented substantially opposite the heel of the iron. Such a position of the ventilation orifice further limits the risks of liquid flowing through the vent.

According to one embodiment of the invention, the ventilation orifice is oriented in a first direction and the vent is oriented in a second direction, which is transverse to the first direction.

According to one embodiment of the invention, when the fill opening is in the closed position and the iron rests on the heel, the outlet of the ventilation orifice which opens into the internal reservoir is located at a height higher than that of the vent. Such a configuration of the ventilation orifice further limits the risks of liquid flowing through the vent.

According to one embodiment of the invention, the seal comprises an internal cavity fluidly connected to the vent, with the ventilation orifice opening into the internal cavity.

According to one embodiment of the invention, the vent opens into the internal cavity.

According to one embodiment of the invention, the internal cavity extends in an extension direction which is transverse to the first direction.

According to one embodiment of the invention, the direction of extension of the internal cavity is substantially parallel to the second direction.

According to one embodiment of the invention, the mounting part is tubular and partially delimits the internal cavity.

According to one embodiment of the invention, the barrier part partially delimits the internal cavity.

According to one embodiment of the invention, the barrier part comprises a side wall, extending from the sealing part and in the direction of the internal reservoir when the fill opening is in the closed position, and a barrier wall which extends from the side wall and transversely to the side wall. Such an arrangement of the barrier part considerably reduces the risks of liquid flowing through the ventilation orifice.

According to one embodiment of the invention, the ventilation orifice is provided on the side wall of the barrier part, and for example on a portion of the side wall of the barrier part that is opposite the heel of the iron.

According to one embodiment of the invention, the barrier part is tubular, and the barrier wall forms an end wall of the barrier part.

According to one embodiment of the invention, the barrier wall is provided with a barrier edge, which is opposite to the heel of the iron, and which is located at a height greater than a maximum level of liquid in the internal reservoir when the fill opening is in the closed position and the iron rests on the heel.

According to one embodiment of the invention, the ventilation orifice is next to the barrier edge of the barrier wall.

According to one embodiment of the invention, the sealing part is annular.

According to one embodiment of the invention, the sealing part is located between the mounting part and the barrier part.

According to one embodiment of the invention, the mounting part comprises at least one latching member configured to cooperate with an additional latching element provided on the fill opening.

According to one embodiment of the invention, the fill opening comprises a receiving casing configured to house at least part of the mounting part.

According to one embodiment of the invention, the vent opens into the receiving casing.

According to one embodiment of the invention, the fill opening is pivotally mounted between the closed position and the open position.

According to one embodiment of the invention, the fill opening is removably mounted on the case.

According to one embodiment of the invention, the iron comprises a heating body comprising a vaporization chamber which is intended to be supplied with liquid from the internal reservoir and that is configured to produce steam.

According to one embodiment of the invention, the iron comprises an ironing soleplate provided with an ironing surface and at least one steam outlet orifice opening into the ironing surface, and a distribution circuit for steam fluidly connecting the vaporization chamber to at least one steam outlet orifice in which the steam produced by the vaporization chamber is intended to flow.

According to one embodiment of the invention, the iron comprises a liquid spraying member which is located on a front part of the case and which is configured to be supplied with liquid from the internal reservoir.

BRIEF DESCRIPTION OF THE DRAWINGS

The invention will be understood better with the help of the description below with reference to the attached schematic drawings showing, by way of nonlimiting example, an embodiment of this iron.

FIG. 1 is a longitudinal section view of an iron according to an embodiment of the present invention in the position of use.

FIG. 2 is a longitudinal section view of the iron of FIG. 1 resting on its heel.

FIG. 3 is an enlarged view of a detail in FIG. 2.

FIG. 4 is a perspective view of a seal of the iron of FIG. 1.

FIG. 5 is a side view of the seal of FIG. 4.

FIG. 6 is another perspective view of the seal of FIG. 4.

DETAILED DESCRIPTION

FIGS. 1 to 5 show an iron 2 comprising a case 3 comprising in particular a gripping part 4 and a heel 5 which is located in a rear part of the case 3 and on which the iron 2 can rest during the inactive ironing phases.

The iron 2 further comprises an internal reservoir 6 integrated in the case 3, and a fill opening 7 fluidly connected to the internal reservoir 6 and opening into a front surface of the case 3. The fill opening 7 is more particularly configured to allow at least the partial filling of the internal reservoir 6 with a liquid, such as water.

The iron 2 further comprises an ironing soleplate 8 provided with an ironing surface 9 which is substantially flat and with several steam outlet orifices 11 opening into the ironing surface 9.

The iron 2 also includes a heating body 12 integrated into a lower part of the case 3, and thermally and mechanically linked to the ironing soleplate 8. The heating body 12 may, for example, include a foundry 13, for example made of aluminum, and a resistive heating element 14 bent in a U shape and integrated in the foundry 13.

The heating body 12 also includes a closing plate 15 which rests on the foundry 13, and a vaporization chamber 16, of the instantaneous vaporization type, intended to be supplied with liquid from the internal reservoir 6 and configured to generate a steam flow.

The iron 2 further comprises a steam distribution circuit defined by the foundry 13 and the closing plate 15, and fluidly connecting the vaporization chamber 14 to the steam outlet orifices 11, so that the flow steam generated in the vaporization chamber 16 can flow to the steam outlet orifices 11.

The iron 2 also includes a steam control member 17 included in the iron 2 and intended to be activated manually by a user. The steam control member 17 may be in the form of a steam control button or a steam control trigger.

The iron 2 further comprises a supply circuit fluidly connected to the internal reservoir 6 and configured to supply liquid to the vaporization chamber 16 when the steam control member 17 is activated by a user. The supply circuit may, for example, include a supply device 18 carried by the case 3, and for example a drip feed device. The supply device 18 may in particular comprise a closure element 19, such as a closure rod, movable in translation between a closure position in which the closure element 19 interrupts the supply of liquid from the vaporization chamber 16, and a supply position in which the liquid coming from the internal reservoir 6 can flow towards the vaporization chamber 16.

According to an alternative embodiment of the invention, the drip feed device can be replaced by a feed pump, such as a manual or electric feed pump.

The iron 2 further comprises a fill opening cover 21 mounted mobile, and for example pivoting, on the case 3 between a closed position in which the fill opening cover 21 covers the fill opening 7 and prevents the filling of the internal reservoir 6 and an open position in which the fill opening cover 21 at least partially frees the fill opening 7 and allows the filling of the internal reservoir 6.

The iron 2 also comprises a seal 22 comprising a mounting part 23 which is fixed to the fill opening cover 21 and a sealing part 24 which is configured to seal the fill opening 7 when the fill opening cover 21 is in the closed position.

According to the embodiment shown in the figures, the mounting part 23 is tubular and the fill opening cover 21 comprises a receiving casing 25 in which the mounting part 23 is housed at least partially. Advantageously, the mounting part 23 comprises two latching members 26, each configured to cooperate with an additional latching element (not visible in the figures) provided on the fill opening cover 21, and more particularly on an internal surface of the receiving casing 25.

The seal 22 also includes a barrier part 27 which extends into the internal reservoir 6 when the fill opening cover 21 is in the closed position, and a ventilation orifice 28 which opens into the internal reservoir 6 when the fill opening cover 21 is in the closed position. Advantageously, the sealing part 24 is annular, and is located between the mounting part 23 and the barrier part 27.

According to the embodiment shown in the figures, the barrier part 27 has a side wall 29 extending from the sealing part 24 and in the direction of the internal reservoir 6 when the fill opening cover 21 is in the closed position, and a barrier wall 30 which extends from the side wall 29 and transversely to the side wall 29. Advantageously, the barrier part 27 is tubular, and the barrier wall 30 forms an end wall of the barrier part 27. Advantageously, the ventilation orifice 28 is provided on the side wall 29 of the barrier part 27. The seal 22 is preferably produced by a molding process and the barrier wall 30 may advantageously include alveolus 30A necessary for the molding process of the seal 22, these alveolus 30A being closed and, therefore, not allowing liquid to pass through the barrier wall 30.

The barrier wall 30 is provided with a barrier edge 31 which is opposite the heel 5 of the iron 2 and which is situated at a height greater than a maximum liquid level in the internal reservoir 6 when the fill opening cover 21 is in the closed position and the iron 2 rests on the heel 5. Advantageously, the ventilation hole 28 is contiguous with the barrier edge 31 of the barrier wall 30, and the ventilation hole 28 is oriented substantially opposite to the heel 5 of the iron 2 when the fill opening cover 21 is in the closed position.

The seal 22 also comprises an internal cavity 32 delimited by the mounting part 23, the sealing part 24, and the barrier part 27. Advantageously, the ventilation orifice 28 opens into the internal cavity 32.

The iron 2 also has a vent 33 which is provided on the fill opening cover 21, and which is fluidly connected to the ventilation orifice 28. Thus, the vent 33 is configured to be fluidly connected to the internal reservoir 6 when the fill opening cover 21 is in the closed position. Advantageously, the vent 33 opens, on the one hand, to the outside of the iron 2 and, on the other hand, into the receiving casing 25, and therefore into the internal cavity 32 of the seal 22.

According to the embodiment shown in the figures, the ventilation orifice 28 is oriented in a first direction and the vent 33 is oriented in a second direction, which is transverse to the first direction. Advantageously, when the fill opening cover 21 is in the closed position and the iron 2 rests on the heel 5, the outlet of the ventilation orifice 28 which opens into the internal reservoir 6, that is to say, the end of the ventilation orifice 28 which opens into the internal reservoir 6, is located at a height higher than that of the vent 33.

The barrier part 27 and the ventilation orifice 28 are more particularly configured so as to prevent liquid from flowing from the internal reservoir 6 and through the vent 33 when the fill opening cover 21 is in the closed position and the iron 2 rests on the heel 5. Advantageously, the barrier part 27 and the ventilation orifice 28 can be configured so as to also prevent liquid from flowing from the internal reservoir 6 and through the ventilation orifice 28 when the fill opening cover 21 is in the closed position and the iron 2 rests on the heel 5.

Such a configuration of the iron 2, and in particular of the barrier part 27 and the ventilation orifice 28, avoids an accumulation of water droplets near the fill opening 7 and considerably reduces, and even eliminates, the risk of water flowing through the ventilation orifice 28 when the iron 2 is moved from a position of use to a position in which the latter rests on its heel 5. Consequently, the seal 22 according to the present invention avoids a flow of water droplets through the vent 33 and along the exterior surface of the fill opening cover 21 and of the exterior surface of the case 3.

When understood correctly, the invention is never limited to the embodiment described and illustrated, since this embodiment was only provided by way of example. It is still possible to make amendments, specifically in terms of the way in which the various elements are composed or in terms of substituting equivalent techniques, provided that they remain within the scope of the invention.

The invention claimed is:

1. An iron comprising:

a case equipped with a heel located in a rear part of the case and on which the iron is configured to rest during inactive ironing phases;

an internal reservoir;

a fill opening fluidly connected to the internal reservoir and opening into a front surface of the case of the iron;

a fill opening cover movable between a closed position in which the fill opening cover covers the fill opening and an open position in which the fill opening cover at least partially exposes the fill opening;

a seal comprising a mounting part fixed to the fill opening cover and a sealing part configured to seal the fill opening when the fill opening cover is in the closed position; and a vent provided on the fill opening cover, the vent opening to the outside of the iron and in fluid connection with the internal reservoir when the fill opening cover is in the closed position, wherein the seal includes a barrier part extending into the internal reservoir when the fill opening cover is in the closed position, and a ventilation orifice fluidly connected to the vent and opening into the internal reservoir when the fill opening cover is in the closed position, wherein the barrier part includes a barrier wall devoid of openings in fluid communication with the ventilation orifice and the vent, the barrier wall extending between the ventilation orifice and the internal reservoir up to a barrier edge that is located above a maximum liquid level in the internal reservoir when the fill opening cover is in the closed position and the iron is resting on the heel, the barrier part and the ventilation orifice thereby being configured to prevent liquid from flowing from the internal reservoir and through the vent when the fill opening cover is in the closed position and the iron is resting on the heel.

2. The iron according to claim 1, wherein, when the fill opening cover is in the closed position, the ventilation orifice is oriented substantially opposite the heel.

3. The iron according to claim 1, wherein the ventilation orifice is oriented in a first direction and the vent is oriented in a second direction transverse to the first direction.

4. The iron according to claim 1, wherein, when the fill opening cover is in the closed position and the iron rests on the heel, the outlet of the ventilation orifice is located at a height higher than that of the vent.

5. The iron according to claim 1, wherein the seal has an internal cavity fluidly connected to the vent, the ventilation orifice opening into the internal cavity.

6. The iron according to claim 1, wherein the barrier part has a side wall extending from the sealing part and in a direction of the internal reservoir when the fill opening cover is in the closed position, and the barrier wall extend from the side wall and transversely to the side wall.

7. The iron according to claim 6, wherein the barrier part is tubular, and the barrier wall forms an end wall of the barrier part.

8. The iron according to claim 6, wherein the barrier wall comprises the barrier edge and the barrier edge is opposite to the heel of the iron.

9. The iron according to claim 8, wherein the ventilation orifice is contiguous with the barrier edge of the barrier wall.

10. An iron comprising:

a case equipped with a heel located in a rear part of the case and on which the iron is configured to rest during inactive ironing phases;

an internal reservoir;

a fill opening fluidly connected to the internal reservoir and opening into a front surface of the case of the iron;

a fill opening cover movable between a closed position in which the fill opening cover covers the fill opening and an open position in which the fill opening cover at least partially exposes the fill opening;

a seal comprising a mounting part fixed to the fill opening cover and a sealing part configured to seal the fill opening when the fill opening cover is in the closed position; and a vent provided on the fill opening cover, the vent opening to the outside of the iron and in fluid connection with the internal reservoir when the fill opening cover is in the closed position, wherein the seal includes a barrier part extending into the internal reservoir when the fill opening cover is in the closed position, and a ventilation orifice fluidly connected to the vent and opening into the internal reservoir when the fill opening cover is in the closed position, wherein the barrier part and the orifice ventilation are configured to prevent liquid from flowing from the internal reservoir and through the vent when the fill opening cover is in the closed position and the iron is resting on the heel, and wherein, when the fill opening cover is in the closed position and the iron rests on the heel, the outlet of the ventilation orifice is located at a height higher than that of the vent.

11. The iron according to claim 10, wherein features of the seal that are immovable relative to one another and include the barrier and the ventilation orifice cooperate to prevent liquid from flowing from the internal reservoir and through the vent when the fill opening cover is in the closed position and the iron is resting on the heel.

12. The iron according to claim 10, wherein the barrier extends above and below the ventilation orifice when the fill opening cover is in the closed position and the iron is resting on the heel.

13. The iron according to claim 12, wherein, when the fill opening cover is in the closed position, the ventilation orifice is oriented substantially opposite the heel.

14. An iron comprising:

a case equipped with a heel located in a rear part of the case and on which the iron is configured to rest during inactive ironing phases;

an internal reservoir;

a fill opening fluidly connected to the internal reservoir and opening into a front surface of the case of the iron;

a fill opening cover movable between a closed position in which the fill opening cover covers the fill opening and an open position in which the fill opening cover at least partially exposes the fill opening;

a seal comprising a mounting part fixed to the fill opening cover and a sealing part configured to seal the fill opening when the fill opening cover is in the closed position; and a vent provided on the fill opening cover, the vent opening to the outside of the iron and in fluid connection with the internal reservoir when the fill opening cover is in the closed position, wherein the seal includes a barrier part extending into the internal reservoir when the fill opening cover is in the closed position, and a ventilation orifice fluidly connected to the vent and opening into the internal reservoir when the fill opening cover is in the closed position, wherein, when the fill opening cover is in the closed position, the ventilation orifice is oriented substantially opposite the heel and has an upper opening that is located higher than a maximum liquid level, and the seal has an internal cavity located between the vent and the ventilation orifice and into which the vent and the ventilation orifice open, the fluid cavity extending lower than a lower end of the vent when the fill opening cover is in the closed position and the iron is resting on the heel.

15. The iron according to claim 14, wherein the internal cavity defines an only path of fluid communication between the ventilation orifice and the vent within an assembly of the fill opening cover and the seal.

16. The iron according to claim 14, wherein an end of the ventilation orifice that opens into the internal cavity is lower than an end of the vent that opens into the internal cavity when the fill opening cover is in the closed position and the iron is in a position of use.

17. The iron according to claim 14, wherein the barrier part includes a barrier wall devoid of openings in fluid communication with the ventilation orifice and the vent, the barrier wall extending between the ventilation orifice and the internal reservoir up to a barrier edge that is located above a maximum liquid level in the internal reservoir when the fill opening cover is in the closed position and the iron is resting on the heel.

* * * * *